US007900419B2

(12) United States Patent
Kodi

(10) Patent No.: US 7,900,419 B2
(45) Date of Patent: Mar. 8, 2011

(54) METHOD OF ATTACHING REINFORCING BARS

(75) Inventor: Jon R. Kodi, Lebanon, TN (US)

(73) Assignee: Kodi Klip Corporation, Lebanon, TN (US)

( * ) Notice: Subject to any disclaimer, the term of this patent is extended or adjusted under 35 U.S.C. 154(b) by 0 days.

(21) Appl. No.: 12/173,076

(22) Filed: Jul. 15, 2008

(65) Prior Publication Data

US 2008/0271409 A1 Nov. 6, 2008

Related U.S. Application Data

(63) Continuation of application No. 11/122,195, filed on May 3, 2005, now abandoned.

(51) Int. Cl.
*E04B 1/00* (2006.01)

(52) U.S. Cl. ..... 52/745.21; 52/677; 52/688; 52/719

(58) Field of Classification Search ..... 52/677, 52/684, 719, 687, 688; 403/393; 29/464, 29/466, 467, 468; 24/129 D, 545, 129 R, 24/339, 336

See application file for complete search history.

(56) References Cited

U.S. PATENT DOCUMENTS

| | | | | |
|---|---|---|---|---|
| 577,220 | A | 2/1897 | Whitehead | |
| 593,978 | A | 11/1897 | Boehm | |
| 0,721,434 | A | 2/1903 | Edeburn | |
| 942,007 | A | 11/1909 | Morrill | |
| 1,398,519 | A | 11/1921 | Hosch | |
| 1,451,717 | A | 4/1923 | Sommer | |
| 1,852,673 | A | 4/1932 | Pilj | |
| 1,986,528 | A | 1/1935 | Ranger | |
| 2,551,826 | A | 5/1951 | Cox, Sr. | |
| 2,571,337 | A | 10/1951 | Burnham | |
| 2,879,087 | A | 3/1959 | Haglund | |
| 3,006,115 | A | 10/1961 | Hillberg | |
| 3,033,412 | A * | 5/1962 | Fox | 220/23.4 |
| 3,216,752 | A | 11/1965 | Rifken | |
| 3,360,883 | A | 1/1968 | Glanzer | |
| 3,679,250 | A | 7/1972 | Marsden | |
| 3,788,025 | A | 1/1974 | Holmes | |

(Continued)

FOREIGN PATENT DOCUMENTS

JP 4108944 4/1992

(Continued)

OTHER PUBLICATIONS

Exhibit A: Jiffy Clip Long Gun Applicator by Jiffy Clip, Inc. (see www.jiffyclip.com) (undated but admitted to be prior art).

(Continued)

*Primary Examiner* — Brian E Glessner
*Assistant Examiner* — Adriana Figueroa
(74) *Attorney, Agent, or Firm* — Waddey & Patterson, P.C.; Lucian Wayne Beavers

(57) ABSTRACT

A method of attaching and aligning reinforcing bars includes providing a plurality of molded plastic clips having first and second parallel seats and a third transverse seat, all seats of equal size. A lower seat of a clip is pressed over a first reinforcement bar, then a second reinforcement bar is pressed into the upper seat to attach two bars of equal size in parallel. Another identical clip can be used to attach a third bar transverse to the first two bars, all the bars being of equal size.

4 Claims, 4 Drawing Sheets

U.S. PATENT DOCUMENTS 4,002,349 A 1/1977 Dopp
4,034,529 A 7/1977 Lampus
4,060,954 A 12/1977 Liuzza
4,080,770 A 3/1978 Vigh
4,110,951 A 9/1978 Padrun
4,136,984 A 1/1979 Hayashi
4,136,985 A 1/1979 Taul
4,214,841 A 7/1980 Hayashi
4,244,542 A * 1/1981 Mathews ..... 248/49
4,362,423 A 12/1982 Miles
4,388,791 A 6/1983 Anderson
4,407,472 A 10/1983 Beck
4,440,519 A 4/1984 Pennel et al.
4,482,088 A 11/1984 Hyun
4,511,073 A 4/1985 Furutsu
D281,393 S 11/1985 Karnhag et al.
4,610,122 A 9/1986 De Clercq
4,617,775 A 10/1986 Padrun
4,707,892 A 11/1987 Nelson
D295,724 S * 5/1988 Shioda ..... D8/396
D296,074 S 6/1988 Seyfarth
4,807,345 A 2/1989 Jacobson
4,835,933 A 6/1989 Yung
4,968,176 A 11/1990 Balach
4,991,372 A 2/1991 Sonneville
D326,927 S 6/1992 Catalina
5,127,763 A 7/1992 Kunoki
5,370,293 A 12/1994 Bevins
5,371,991 A * 12/1994 Bechtel et al. ..... 52/686
5,379,562 A 1/1995 Hohmann
D355,582 S 2/1995 Sleight
D367,999 S 3/1996 McCallum
5,518,399 A 5/1996 Sicurelli, Jr. et al.
D375,890 S 11/1996 Takai
5,588,554 A 12/1996 Jones
5,595,039 A 1/1997 Lowery
5,626,436 A * 5/1997 Dragone ..... 403/400
5,642,557 A 7/1997 Clews
5,683,025 A 11/1997 Grendol
5,688,428 A 11/1997 Maguire
5,697,591 A 12/1997 Cooper
5,752,297 A 5/1998 Ramey
5,826,629 A 10/1998 West
5,878,546 A 3/1999 Westover
5,881,452 A 3/1999 Nowell, III et al.
5,893,252 A 4/1999 Hardy et al.
5,937,604 A 8/1999 Bowron
5,938,099 A 8/1999 Ciccarelli
D421,318 S * 2/2000 O'Brien et al. ..... D26/138
6,141,937 A 11/2000 Dressler
6,148,488 A 11/2000 Gristock
6,161,360 A * 12/2000 Smith ..... 52/678
6,240,688 B1 6/2001 Dressler
6,276,108 B1 8/2001 Padrun
6,298,525 B1 10/2001 Margo
D454,776 S 3/2002 Padrun
6,354,054 B1 3/2002 Verelli et al.
6,371,763 B1 4/2002 Sicurelli, Jr. et al.
6,513,555 B1 2/2003 Lesser et al.
6,585,142 B1 7/2003 Chen
6,622,352 B2 9/2003 Herron
6,622,976 B1 9/2003 Ianello
6,672,498 B2 1/2004 White et al.
6,725,535 B2 4/2004 Edson et al.
6,857,246 B2 2/2005 Erbetta et al.
6,915,624 B2 7/2005 Shibazaki et al.
6,925,698 B2 8/2005 Goodsmith et al.
6,971,515 B2 12/2005 Cooper et al.
7,003,860 B2 2/2006 Bloch et al.
D529,794 S 10/2006 Murray
7,147,209 B2 12/2006 Jones et al.
7,152,831 B2 12/2006 Riedy et al.
D534,418 S 1/2007 Minor et al.
2003/0154579 A1 8/2003 Disher
2004/0040247 A1 3/2004 Morse
2004/0154261 A1 8/2004 Miller
2004/0261352 A1 12/2004 Bennett et al.
2005/0217198 A1 10/2005 Carraher et al.
2007/0284385 A1 12/2007 Carraher et al.
2008/0118304 A1 * 5/2008 Carraher et al. ..... 403/396

FOREIGN PATENT DOCUMENTS

WO 2006031407 A2 3/2006
WO 2006033883 A2 3/2006

OTHER PUBLICATIONS

Office Action dated May 25, 2010 from related co-pending U.S. Appl. no. 11/622,674. (not prior art).
Office Action dated Oct. 13, 2010 from related co-pending U.S. Appl. No. 11/778,174. (not prior art).

* cited by examiner

METHOD OF ATTACHING REINFORCING BARS

This application is a continuation of U.S. patent Application Ser. No. 11/122,195 of Kodi, filed May 3, 2005, entitled "Bar Clip With Flared Legs",the details of which are incorporated herein by reference.

BACKGROUND OF THE INVENTION

The present invention relates generally to an apparatus and method of attaching and aligning reinforcing bars in a framework for supporting a concrete matrix. More particularly, this invention pertains to clips for joining reinforcing bars in a framework. Even more particularly, this invention pertains to a clip with flared legs for joining pairs of reinforcing bars in a parallel orientation.

It has been long known in the art of reinforced concrete structures to provide fastening means for aligning and attaching reinforcing bars in a framework prior to encasing such bars in a concrete matrix. One well known fastening means used in forming a framework of reinforcing bars is to wrap adjacent bars with wire ties, or other similar binding materials. Another well known fastening means is to attach such reinforcing bars by welding instead of wrapping. Both of these fastening means provide for attaching bars arranged in either transverse or parallel orientations. However, both means are labor intensive and, thus, more expensive when compared to the use of more recently developed reinforcing bar clips.

Plastic clips have been developed to provide a means of rapidly attaching adjacent reinforcing bars that are arranged in transverse orientations. For example, Padrum, in U.S. Pat. No. 4,110,951, teaches a plastic U-shaped clip formed by two opposing flanges extending from a base. Each of the flanges is split to form opposing and aligned openings within each flange. The clip is positioned and aligned above two reinforcement bars that are in a transverse orientation to each other. Pressure applied to the base causes the first reinforcing bar to be forced between the flanges and held in an upper position. Continued application of pressure upon the base causes the second reinforcing bar to be forced between the opposing split opening in the flanges and held in a lower position independent of the first bar.

A second example of prior art plastic clips is shown in U.S. Pat. No. 5,626,436 to Dragone. The Dragone clip is a U-shaped assembly comprising two parallel longitudinal members connecting two opposed hook assemblies. Each hook assembly comprises two connecting members, each extending from one of the longitudinal members, and a fulcrum section. A hook is formed by two opposing fingers, each attached at an opposite end of the fulcrum section and extending from the fulcrum section in a direction away from the longitudinal members. A gap is formed between each pair of opposing fingers. To install the Dragone clip, a first reinforcing bar is forced between the two opposed hook assemblies and held in an upper position against the parallel longitudinal members. The parallel longitudinal members are squeezed together by the user, causing each pair of opposing fingers to spread apart. The user slips the spread fingers of the opposing hooks over a second reinforcing bar that is positioned transverse to the first bar. The user then releases the parallel longitudinal members. As the parallel longitudinal members separate, each pair of opposing fingers close around the second bar and hold it in a lower position. The Dragone clip is sized so as to hold the second bar against the first bar.

One shortcoming of these two plastic clips is the limited orientations in which they can be used. These clips can only be used with transversely oriented reinforcement bars. However, frameworks of reinforcement bars frequently require attachment of bars in parallel orientations as well as transverse orientations. Previously, no clips existed to attach reinforcement bars in parallel orientations. Where frameworks are constructed using either of the prior art clips, the user can only use such clips to attach transversely oriented bars. All other attachment orientations require the user to employ more labor intensive methods of attaching the bars, such as wire wrap. What is needed, then, is a reinforcement bar clip that can be used to attach adjacent reinforcing bars arranged in a parallel orientation.

To make the task of attaching reinforcement bars in a framework as simple as possible, it would be advantageous if only one type of clip were necessary to join reinforcement bars in either a transverse orientation or in a parallel orientation. Therefore, what is additionally needed is a reinforcement bar clip that can be used to attach adjacent reinforcing bars arranged in either a transverse orientation or in a parallel orientation.

BRIEF SUMMARY OF THE INVENTION

In the preferred embodiment, the present invention includes a color coded molded plastic clip including a pair of opposing clasp assemblies. Each clasp assembly has an upper clasp and a lower clasp for holding, respectively, first and second reinforcement bars in a parallel orientation. Each upper clasp includes a pair of opposing, convexly curved fingers that extend upwards from a transverse support and are attached to a pair of parallel longitudinal supports. Each clasp assembly further includes a second pair of opposing, convexly curved fingers extending downward from either end of the transverse support so as to form a lower clasp.

One novel aspect of the preferred embodiment of the present invention is a pair of flared guides attached to the lower ends of the opposing fingers of each lower clasp. During installation of the clip's lower clasps upon a reinforcement bar, each pair of flared guides engages the bar and guides it to the lower clasp gaps for insertion into the lower clasps.

An alternative embodiment of the present invention additionally includes two alternative upper clasps formed from the longitudinal supports cooperating with the opposed clamp assemblies. Each alternative upper clasp includes an alternative upper seat and an alternative upper clasp gap for receiving and holding a reinforcement bar in an orientation transverse to a reinforcement bar received and held by the lower clasp. Advantageously, the clip of this alternative preferred embodiment can be selectively used to attach and hold two reinforcement bars arranged in either a parallel orientation or in a transverse orientation.

Accordingly it is an object of the present invention to provide a reinforcement bar clip that can be used to attach adjacent reinforcing bars arranged in a parallel orientation.

It is an additional object of the present invention to provide a reinforcement bar clip that can be used to attach adjacent reinforcing bars arranged in either a transverse orientation or in a parallel orientation.

Finally, it is an object of the present invention to provide a means of guiding a reinforcement bar into a clasp during installation of the clip.

DETAILED DESCRIPTION OF THE INVENTION

Figure 1:
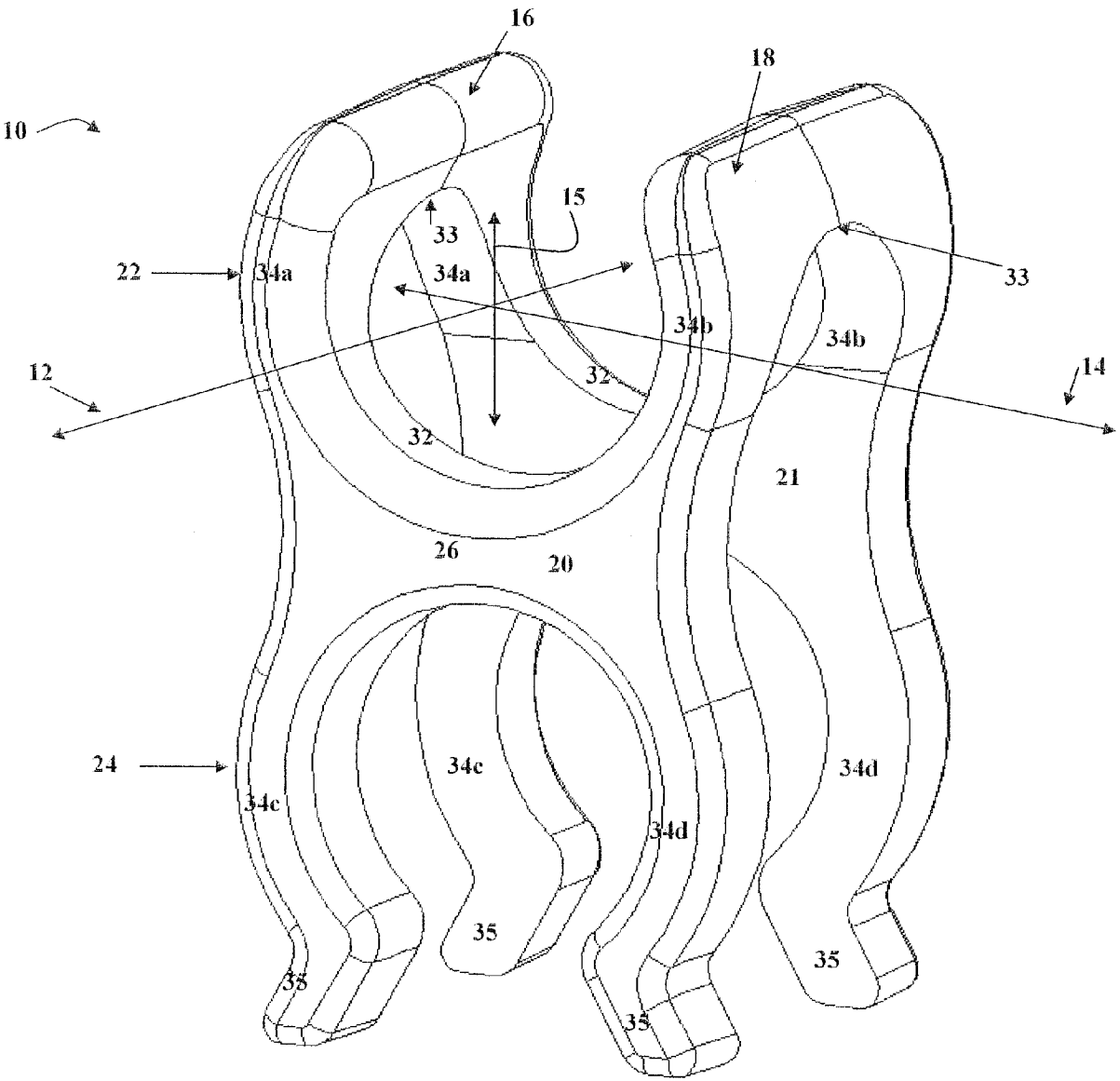
FIG. 1 is an oblique view of a preferred embodiment of the reinforcement bar clip of the present invention.
Figure 3:
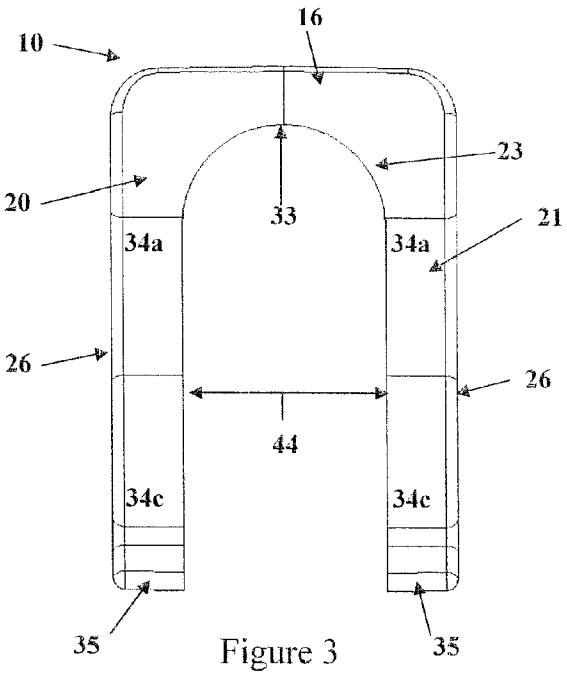
FIG. 3 is a side view of the clip of FIG. 1 along the transverse axis.

One preferred embodiment of the reinforcement bar clip 10 of the present invention is shown in FIG. 1, wherein orientation of the clip 10 is shown with reference to the vertical direction arrow 15, the longitudinal direction arrow 12 and the transverse direction arrow 14. The embodiment shown in FIG. 1 is a molded plastic clip 10 made of a resilient plastic material having a color selected to indicate the appropriate gauge of reinforcement bars upon which it may be installed. The clip 10 comprises a plurality of clasp assemblies. The embodiment shown in FIG. 1 comprises a pair of opposing first and second clasp assemblies 20, 21. Each first and second clasp assembly 20, 21 is attached to parallel first and second longitudinal supports 16, 18 and extends downward from the longitudinal supports 16, 18. The opposing first and second clasp assemblies 20, 21, together with the first and second longitudinal supports 16, 18, form a U-shaped profile, as is shown in FIG. 3.

Figure 2:
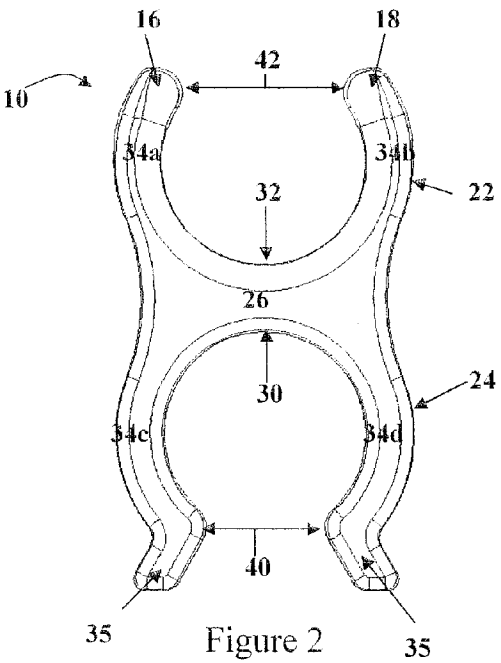
FIG. 2 is an end view of the clip of FIG. 1 along the longitudinal axis.
Figure 4:
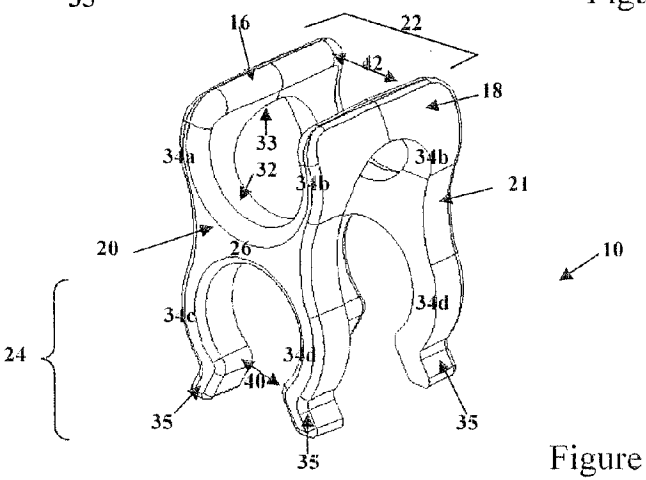
FIG. 4 is oblique view of the clip of FIG. 1.

Referring again to FIG. 1, the first and second clasp assemblies 20, 21 each comprise an upper clasp 22 for holding a first reinforcement bar and a lower clasp 24 for holding a second reinforcement bars in a parallel orientation to the first reinforcement bar. For each first and second clasp assembly 20, 21, opposing, convexly curved fingers 34 extend upward from either end of a transverse support 26 so as to form the upper clasp 22. One finger 34*a* is shown attached to the first longitudinal support 16 and the opposing finger 34*b* is shown attached to the second longitudinal support 18. Together with the transverse support 26, the opposing fingers 34*a*, 34*b* form an upper seat 32. Referring now to FIGS. 1, 2 and 4, an upper clasp gap 42 is disposed between the first and second longitudinal supports 16, 18 so as to provide a means of inserting the first reinforcement bar into the upper clasp 22. The upper clasp gap 42 is selected so as to be narrower than the diameter of the first reinforcement bar, while the upper seat 32 is adapted in size and shape to compressively engage the first reinforcement bar when such bar is placed within the upper clasp 22.

Referring again to FIG. 1, for each first and second clasp assembly 20, 21, opposing, convexly curved fingers 34*c*, 34*d* extend downward from either end of the transverse support 26 so as to form the lower clasp 24. Together with the transverse support 26, the pair of opposing fingers 34*c*, 34*d* form a lower seat 30. Referring now to FIGS. 1, 2 and 4, a lower clasp gap 40 is disposed between the opposing fingers 34*c*, 34*d* so as to provide a means of inserting a reinforcement bar into the lower clasp 24. The lower clasp gap 40 is selected so as to be narrower than the diameter of the second reinforcement bar, while the lower seat 30 is adapted in size and shape to compressively engage the second reinforcement bar when such bar is placed within the lower clasp 24.

The term 'gauge of a clip' is used herein to indicate the size of bar that the clip can attach and hold. In the preferred embodiment of the present invention, the gauge of the clip 10 is indicated by the color of the material used to fabricate the clip 10. For example, a clip 10 having a red color may have a gauge of 0.425 inches and a clip 10 having a white color may have a gauge of 0.525 inches. Other color coding schemes would be obvious to one skilled in the skilled in the art. Optionally, the gauge of the clip is cast, printed or otherwise numerically indicated on the surface of the clip 10. Preferably, the gauge of the clip is indicated by both color of the clip 10 and by the color of the material used to fabricate the clip 10.

A preferred method of installing the clip 10 upon parallel oriented reinforcement bars is described. The gauge of the reinforcement bars is determined and the appropriate size of clip 10 is selected as indicated above. The receiver tip in the preferred embodiment of the application tool (not shown) is interchangeable and is selected by the gauge appropriate for installation into the upper clasp gap 42. The clip 10 is removably installed upon the application tool by sliding the receiver tip into the upper clasp gap 42 so as to form a rigid assembly held together by a friction fit between the receiver tip and the first and second longitudinal supports 16, 18.

One novel aspect of the present invention is the flared guide 35 attached to the lower ends of each opposing finger 34*c*, 34*d* of the lower clasp 24. During installation of the lower clasp 24 of the clip 10 upon a reinforcement bar 52, each pair of flared guides 35 engage the bar 52 and guide it to the lower clasp gap 40 for insertion into the lower clasp 24 of each clasp assembly 20, 21. As the lower clasp 24 is pressed against the reinforcement bar 52, the flaring of guides 35 cause the opposing fingers 34*c*, 34*d* to spread open so as to enlarge the lower clasp gap 40 sufficiently for the insertion of the bar 52. After the bar 52 is inserted into the lower clasp 24, the opposing fingers 34*c*, 34*d* close so as to hold the bar in the lower seat 30.

Figure 6:
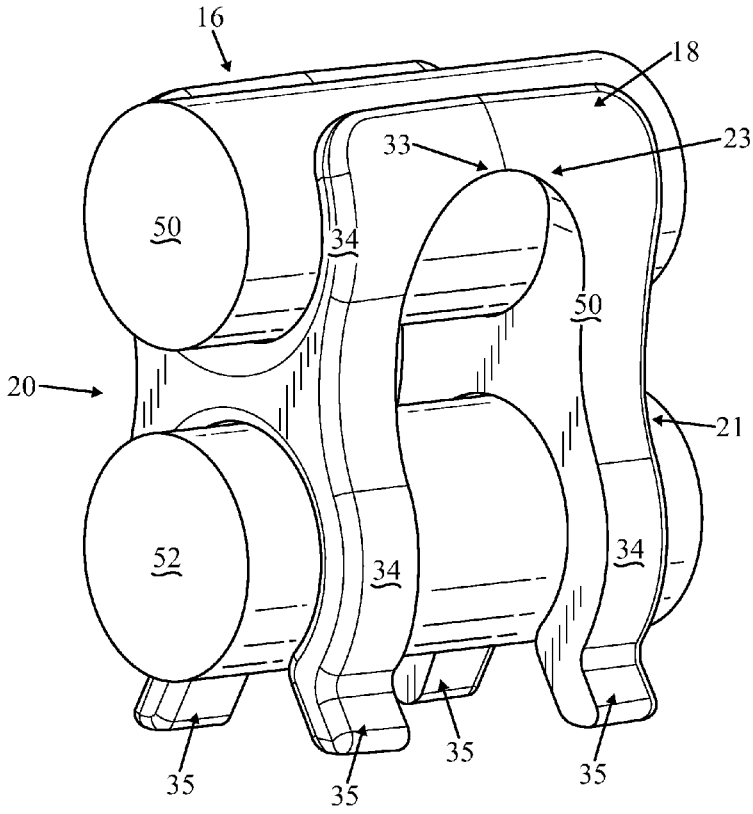
FIG. 6 is a similar oblique view of the clip of FIG. 1 shown holding two reinforcement bars in a parallel orientation.

Once the reinforcing bar 52, is inserted into the lower clasp 24, the receiver tip of the application tool is removed from the upper clasp gap 42. With the upper clasp gap 42 clear, another reinforcement bar 50, is positioned above the upper clasp gap 42 and in a parallel orientation to the reinforcement bar 52 held in the lower clasp 24. The bar 50 and the clip 10 are forced together so as to cause the opposing fingers 34*a*, 34*b* to spread open so as to enlarge the upper clasp gap 42 sufficiently for the insertion of the bar 50. After the bar 50 is inserted into the upper clasp 22, the opposing fingers 34*a*, 34*b* close so as to hold the bar in the upper seat 32. In this configuration, the preferred embodiment of the clip 10 of the present invention holds the two reinforcement bars 50, 52 independent of the other bar and a parallel orientation with the other bar as shown in FIG. 6.

In an alternative preferred embodiment (not shown), flared guide 35 are attached to the upper ends of each opposing finger 34*a*, 34*b* and longitudinal supports 16, 18 of the upper clasp 22. During installation of the upper clasp 22 of the clip 10 upon a reinforcement bar 50, each pair of flared guides 35 engage the bar 50 and guide it to the upper clasp gap 42 for insertion into the upper clasp 22 of each clasp assembly 20, 21 in the same manner described above for the lower clasp 24.

Figure 5:
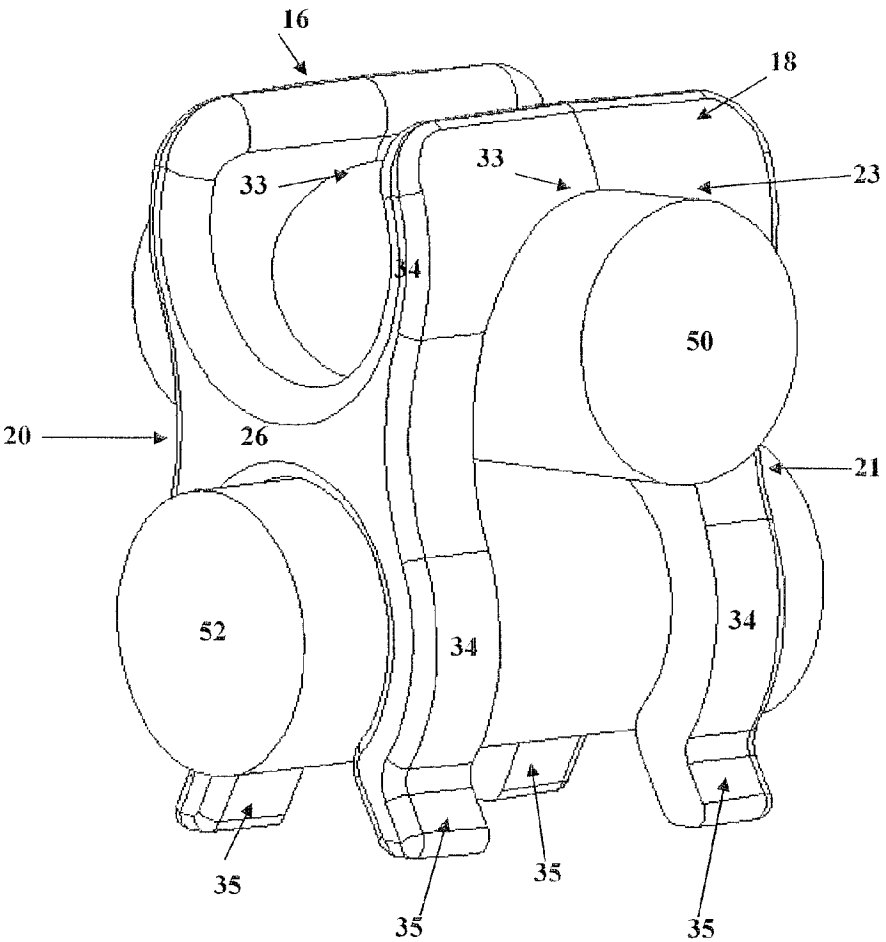
FIG. 5 is an oblique view of the clip of FIG. 1 shown holding two reinforcement bars in a transverse orientation.

Referring to FIGS. 3 and 5, an additional preferred embodiment is shown. In the embodiment shown, longitudinal supports 16, 18 each cooperate with the opposed clamp assemblies 20, 21 to form two aligned and opposing alternative upper clasps 23. Each alternative upper clasp 23 includes an alternative upper seat 33 and an alternative upper clasp gap 44. This additional preferred embodiment also includes upper and lower clasps 22, 24 as previously described. In one application of this additional preferred embodiment, a first reinforcement bar is placed into the alternate upper clasps 23 by forcing the bar 50 into the alternate upper clasp gaps 44 and against the alternative upper seats 33. A second reinforcement bar 52 is oriented in a position transverse to the first bar. The second bar 52 is then forced into the lower clasps 24 so as to contact the first bar 50 and to hold it against the alternative upper seats 33. In the configuration shown in FIG. 5, the clip 10 of this additional preferred embodiment attaches and holds two reinforcement bars 50, 52 in a transverse orientation.

Advantageously, the clip 10 of this alternative preferred embodiment can selectively attach and hold two reinforcement bars 50, 52 in either a parallel orientation, as described above, or in a transverse orientation as shown in FIG. 5. This aspect of the invention allows a single type of clip to be used to attach adjacent reinforcing bars arranged in either a transverse orientation or in a parallel orientation.

Thus, although there have been described particular embodiments of the present invention of a new and useful Method of Attaching Reinforcing Bars, it is not intended that such references be construed as limitations upon the scope of this invention except as set forth in the following claims.

What is claimed is:

1. A method of attaching and aligning reinforcing bars for supporting a concrete matrix, comprising:

(a) providing a plurality of substantially identical molded plastic clips for alternatively attaching and holding two parallel reinforcing bars of equal diameter or two transverse reinforcing bars of equal diameter, each clip including:

two transverse supports;

two pairs of lower legs extending downwardly from the two transverse supports, the two pairs of lower legs defining spaced lower seats of a first diameter, each pair of lower legs having a lower gap defining an opening from lower ends of the lower legs to the lower seats;

two pairs of upper legs extending upwardly from the two transverse supports, the two pairs of upper legs defining spaced upper longitudinal seats parallel to the lower seats and having diameters equal to the first diameter of the lower seats;

two longitudinal supports extending between the two pairs of upper legs, the two longitudinal supports joining upper ends of one pair of upper legs to upper ends of the other pair of upper legs, the two longitudinal supports having an upper gap therebetween defining an opening to the upper longitudinal seats; and two spaced upper transverse seats defined on lower surfaces of the two longitudinal supports, the upper transverse seats being transverse to the lower seats and having diameters equal to the first diameter of the lower seats;

(b) engaging the lower legs of a first one of said clips with a first reinforcement bar and pressing the clip against the first reinforcement bar and spreading open the lower gap sufficiently for insertion of the first reinforcement bar into the lower seats of the clip;

(c) positioning a second reinforcement bar of equal diameter as the first reinforcement bar in position above the first one of the clips and in a parallel orientation to the first reinforcement bar held in the lower seats, and then engaging the second reinforcement bar with the two longitudinal supports and pressing the second reinforcement bar against the clip and spreading open the upper gap sufficiently for insertion of the second bar into the upper longitudinal seats of the clip;

(d) positioning a third reinforcement bar of equal diameter as the first reinforcement bar transversely to one of the first and secnd reinforcement bars; and (e) placing a second one of said clips over the third reinforcement bar and said one of the first and secnd reinforcement bars so that the third reinforcement bar is received in the upper transverse seats of said second clip and so that said one of the first and second reinforcement bars is received in the lower seats of the second clip;

wherein in step (a), the upper gap is larger than the lower gap when each clip is in an unstressed position prior to steps (b)-(e).

2. The method of claim 1, wherein:

in step (a), each pair of lower legs of each clip has outwardly flared lower ends; and in step (b), the engaging includes engaging the flared lower ends of the lower legs with the first reinforcement bar.

3. The method of claim 1, wherein:

step (b) includes compressively engaging the first reinforcement bar with the lower legs when the first reinforcement bar is received in the lower seats; and step (c) includes compressively engaging the second reinforcement bar with the upper legs when the second reinforcement bar is received in the upper seats.

4. The method of claim 1, wherein:

the first and second parallel reinforcing bars are spaced apart from each other by the two transverse supports of the first one of the clips.

* * * * *

UNITED STATES PATENT AND TRADEMARK OFFICE

CERTIFICATE OF CORRECTION

PATENT NO. : 7,900,419 B2
APPLICATION NO. : 12/173076
DATED : March 8, 2011
INVENTOR(S) : Kodi It is certified that error appears in the above-identified patent and that said Letters Patent is hereby corrected as shown below:

Column 6, line 20, replace “secnd” with --second--.
Column 6, line 22, replace “secnd” with --second--.

Signed and Sealed this
Third Day of May, 2011

David J. Kappos

David J. Kappos
*Director of the United States Patent and Trademark Office*